US006811235B1

(12) United States Patent
Brunette

(10) Patent No.: US 6,811,235 B1
(45) Date of Patent: Nov. 2, 2004

(54) REFRIGERATOR-MOUNTED MEDICINE BOX ASSEMBLY

(76) Inventor: Kimberly A. Brunette, 418 Vanier Dr., Unit D1, Kitchener, Ontario (CA), N2C 1K2

( * ) Notice: Subject to any disclaimer, the term of this patent is extended or adjusted under 35 U.S.C. 154(b) by 100 days.

(21) Appl. No.: 10/266,951

(22) Filed: Oct. 9, 2002

(51) Int. Cl.[7] ..... A47B 96/04
(52) U.S. Cl. ..... 312/404; 312/245
(58) Field of Search ..... 312/404, 246, 312/245; 211/113, 117, 181.1, 85.29, 103, 106.01; 248/318, 320, 231.31

(56) References Cited

U.S. PATENT DOCUMENTS 1,774,312 A * 8/1930 Braeutigam ..... 62/382
1,857,522 A * 5/1932 Ungeheuer ..... 220/8
2,238,635 A * 4/1941 Fletcher ..... 62/441
3,008,785 A * 11/1961 Gehrs ..... 312/209
3,310,270 A * 3/1967 Ciancio ..... 248/210
3,339,994 A * 9/1967 Reddig et al. ..... 312/301
3,712,696 A * 1/1973 McDonnell ..... 312/245
6,681,941 B1 * 1/2004 Johnson ..... 211/86.01

* cited by examiner

*Primary Examiner*—Janet M. Wilkens

(57) ABSTRACT

A refrigerator-mounted medicine box assembly for safeguarding and protecting medicines from children. The refrigerator-mounted medicine box assembly includes a shelving rack being adapted to be mounted in a refrigerator unit; and also includes a container assembly including a container member having top, side, and bottom walls and also and open front side, and also including a door being hingedly attached to the container member and being closable over the open front side with the container member being removably suspended from the shelving rack; and further includes fastening members for suspendably fastening the container member to the shelving rack.

2 Claims, 2 Drawing Sheets

REFRIGERATOR-MOUNTED MEDICINE BOX ASSEMBLY

BACKGROUND OF THE INVENTION

1. Field of the Invention

The present invention relates to refrigerator-mounted medicine boxes and more particularly pertains to a new refrigerator-mounted medicine box assembly for safeguarding and protecting medicines from children.

2. Description of the Prior Art

The use of refrigerator-mounted medicine boxes-is known in the prior art. More specifically, refrigerator-mounted medicine boxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,435,256; U.S. Pat. No. 3,603,657; U.S. Pat. No. 366,338; U.S. Pat. No. 5,785,363; U.S. Pat. No. 6,021,901; and U.S. Pat. No. Des. 393,393.

While these devices fulfill their respective, particular objectives and requirements, the aforementioned patents do not disclose a new refrigerator-mounted medicine box assembly. The prior art includes boxes and compartments stored in refrigerators.

SUMMARY OF THE INVENTION

The general purpose of the present invention, which will be described subsequently in greater detail, is to provide a new refrigerator-mounted medicine box assembly which has many of the advantages of the refrigerator-mounted medicine boxes mentioned heretofore and many novel features that result in a new refrigerator-mounted medicine box assembly which is not anticipated, rendered obvious, suggested, or even implied by any of the prior art refrigerator-mounted medicine boxes, either alone or in any combination thereof. The present invention includes a shelving rack being adapted to be mounted in a refrigerator unit; and also includes a container assembly including a container member having top, side, and bottom walls and also and open front side, and also including a door being hingedly attached to the container member and being closable over the open front side with the container member being removably suspended from the shelving rack; and further includes fastening members for suspendably fastening the container member to the shelving rack. None of the prior art includes the combination of elements of the present invention.

There has thus been outlined, rather broadly, the more important features of the refrigerator-mounted medicine box assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new refrigerator-mounted medicine box assembly which has many of the advantages of the refrigerator-mounted medicine boxes mentioned heretofore and many novel features that result in a new refrigerator-mounted medicine box assembly which is not anticipated, rendered obvious, suggested, or even implied by any of the prior art refrigerator-mounted medicine boxes, either alone or in any combination thereof.

Still another object of the present invention is to provide a new refrigerator-mounted medicine box assembly for safeguarding and protecting medicines from children.

Still yet another object of the present invention is to provide a new refrigerator-mounted medicine box assembly that is easy and convenient to set up and use.

Even still another object of the present invention is to provide a new refrigerator-mounted medicine box assembly that prevents children from gaining access to medicines which need to be stored in a refrigerator unit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
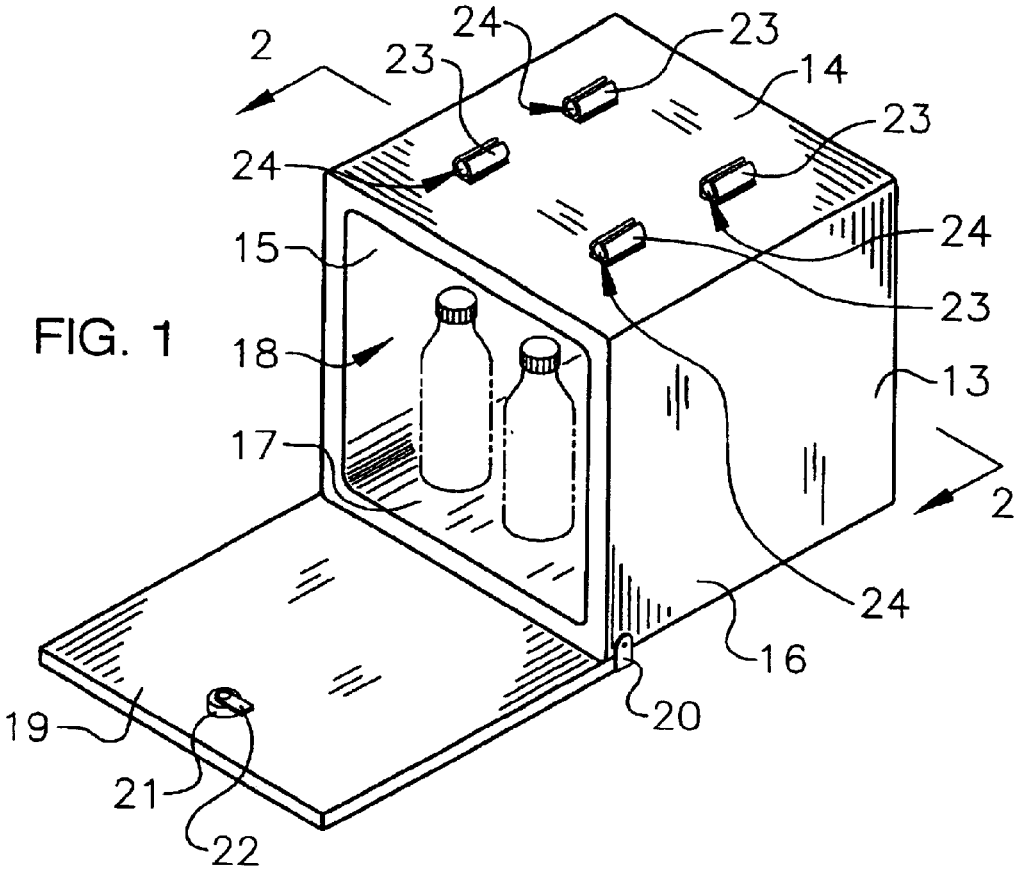
FIG. 1 is a perspective view of a container of a new refrigerator-mounted medicine box assembly according to the present invention.
Figure 2:
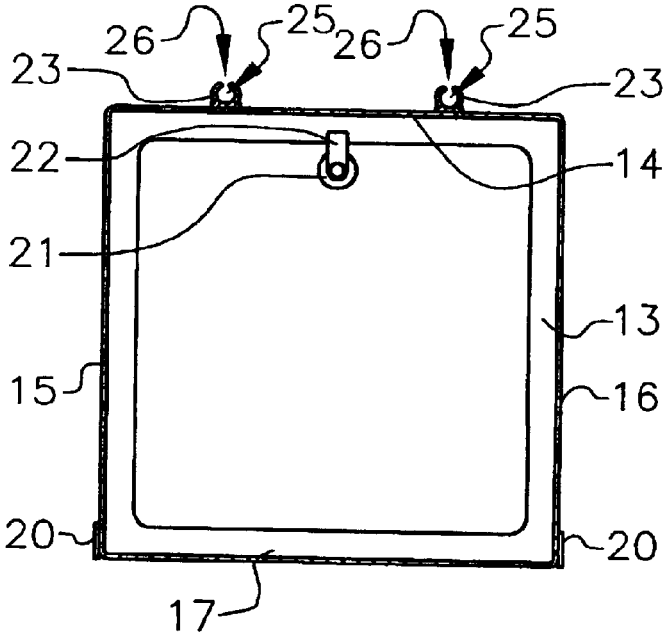
FIG. 2 is a front elevational view of the container of the present invention.
Figure 3:
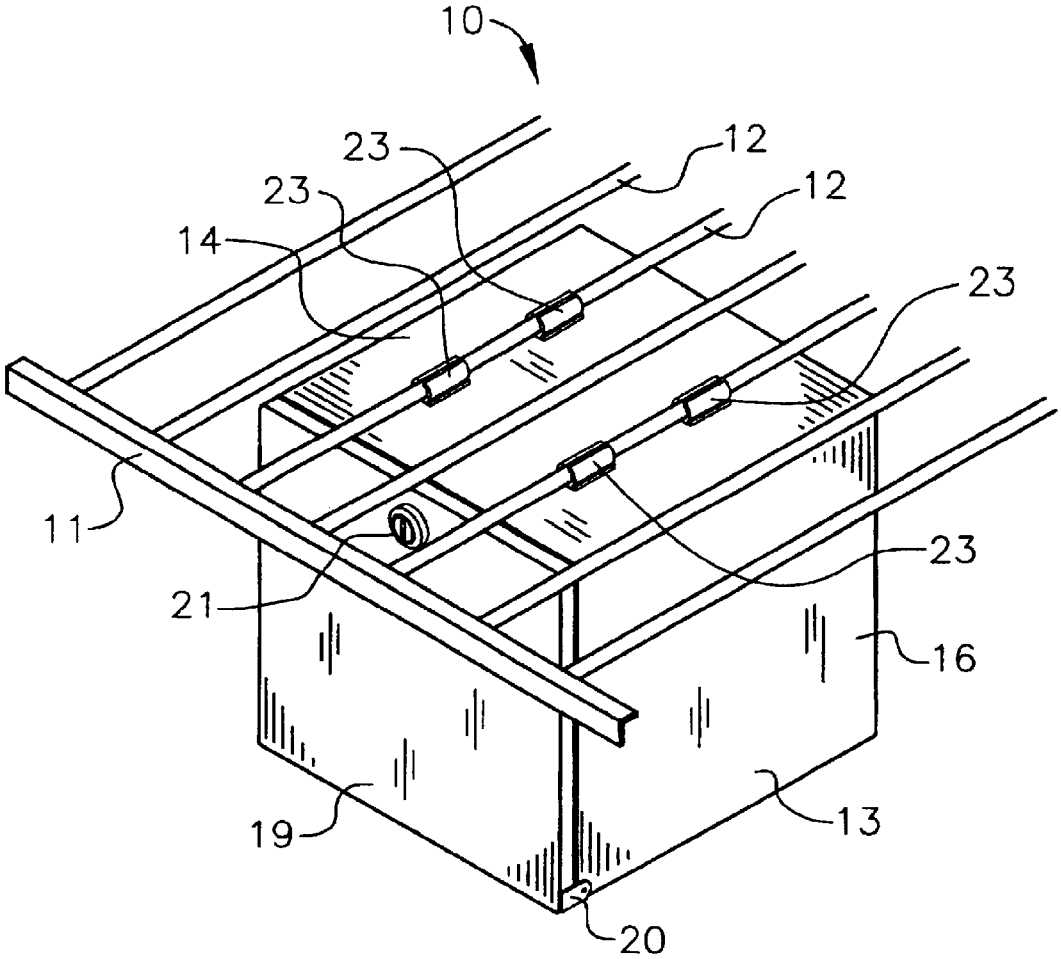
FIG. 3 is a perspective view of the present invention.

With reference now to the drawings, and in particular to FIGS. 1 through 3 thereof, a new refrigerator-mounted medicine box assembly embodying the principles and concepts of the present invention and generally designated by the reference numeral 10 will be described.

As best illustrated in FIGS. 1 through 3, the refrigerator-mounted medicine box assembly 10 generally comprises a shelving rack 11 being adapted to be mounted in a refrigerator unit. The shelving rack 11 includes a plurality of bars 12 being spacedly disposed side-by-side. A container assembly includes a container member 13 having top, side, and bottom walls 14–17 and also an open front side 18, and also includes a door 19 being hingedly and conventionally attached to the container member 13 and being closable over the open front side 18. The container member 13 is removably suspended from the shelving rack 11. The container assembly further includes a locking mechanism 21 being conventionally disposed in the door 19, and also includes a latch 22 being pivotally and conventionally attached to the locking mechanism 21 and being engagable to the top wall 14 of the container member 13, and further includes brackets 20 being hingedly and conventionally attached to the side walls 15,16 of the container member 13 and being conventionally attached to the door 19 at a bottom edge thereof.

Fastening members 23 for suspendably fastening the container member 13 to the shelving rack 11 include resilient and flexible clips being securely and conventionally attached to an outer side of the top wall 14 of the container member 11 and being removably engaged about the bars 12 of the shelving rack 11. Each of the clips is a tubular-shaped member having open ends 24 and a bore 25 extending therethrough, and also having a narrow longitudinal opening 26 extending through the open ends 24 and extending a length of the tubular-shaped member with a respective one of the bars 12 being removably received in the tubular-shaped member through the narrow longitudinal opening 26 and with the tubular-shaped member being removably clamped about the respective bar 12.

In use, the user clips the fastening members 23 to the bars 12 of the shelving rack 11 and unlocks and unlatches the door so that the user can put one's medicines in the container member 13. After doing so, the user than closes and locks the door 19 over the open front side 18 of the container member 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the refrigerator-mounted medicine box assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refrigerator-mounted medicine box assembly comprising:

a shelving rack being adapted to be mounted in a refrigerator unit, said shelving rack including a plurality of bars being spacedly-disposed side-by-side;

a container assembly including a container member having top, side, and bottom walls and also an open front side, and also including a door being hingedly attached to said container member and being closable over said open front side, said container member being removably suspended from said shelving rack, said container assembly further including a locking mechanism being disposed in said door, and also including a latch being pivotally attached to said locking mechanism and being engageable to said top wall of said container member, and further including brackets being hingedly attached to said side walls of said container member and being attached to said door at a bottom edge thereof; and fastening members for suspendably fastening said container member to said shelving rack, said fastening members including resilient and flexible clips being securely attached to an outer side of said top wall of said container member and being removably engaged about said bars of said shelving rack.

2. A refrigerator-mounted medicine box assembly as described in claim 1, wherein each of said clips is a tubular-shaped member having open ends and a bore extending therethrough, and also having a narrow longitudinal opening extending through said open ends and extending a length of said tubular-shaped member, a respective one of said bars being removably received in said tubular-shaped member through said narrow longitudinal opening, said tubular-shaped member being removably clamped about said respective bar.

* * * * *